US011000446B2

(12) United States Patent
Desjardins

(10) Patent No.: US 11,000,446 B2
(45) Date of Patent: May 11, 2021

(54) MASSAGE TOOL

(71) Applicant: REKICK MASSAGE INC., Montréal (CA)

(72) Inventor: Olivier Desjardins, Montréal (CA)

(73) Assignee: REKICK MASSAGE INC., Montréal (CA)

( * ) Notice: Subject to any disclaimer, the term of this patent is extended or adjusted under 35 U.S.C. 154(b) by 40 days.

(21) Appl. No.: 16/487,198

(22) PCT Filed: Feb. 26, 2018

(86) PCT No.: PCT/CA2018/050215
§ 371 (c)(1),
(2) Date: Aug. 20, 2019

(87) PCT Pub. No.: WO2018/152645
PCT Pub. Date: Aug. 30, 2018

(65) Prior Publication Data

US 2020/0375843 A1 Dec. 3, 2020

Related U.S. Application Data

(60) Provisional application No. 62/462,967, filed on Feb. 24, 2017.

(51) Int. Cl.
*A61H 15/00* (2006.01)
*A61H 15/02* (2006.01)
*A61H 23/02* (2006.01)

(52) U.S. Cl.
CPC ..... *A61H 15/0085* (2013.01); *A61H 15/02* (2013.01); *A61H 23/02* (2013.01);
(Continued)

(58) Field of Classification Search
CPC ..... A61H 15/0085; A61H 15/0092; A61H 2015/0007; A61H 2015/0014;
(Continued)

(56) References Cited

U.S. PATENT DOCUMENTS 1,630,149 A * 5/1927 Wahrt ..... D21C 3/26 601/119
1,757,004 A 5/1930 Chapin
(Continued)

FOREIGN PATENT DOCUMENTS

CN 2199775 6/1995
CN 201366065 12/2009
(Continued)

OTHER PUBLICATIONS

English Translation—Machine Generared of CN2199775(Y), "Massage Wheel Stick", published on Jun. 7, 1995.
(Continued)

*Primary Examiner* — LaToya M Louis
(74) *Attorney, Agent, or Firm* — Bereskin & Parr LLP/S.E.N.C.R.L, s.r.l.

(57) ABSTRACT

A massage tool having a massage head with at least one massage wheel mounted on a shaft, the at least one wheel being rotatable; and a handle coupled to the massage head, the handle defining a longitudinal axis that is general perpendicular to a longitudinal axis defined by the shaft.

17 Claims, 8 Drawing Sheets

(52) U.S. Cl.
CPC ..... *A61H 2015/0021* (2013.01); *A61H 2201/0107* (2013.01); *A61H 2201/1685* (2013.01); *A61H 2201/5043* (2013.01); *A61H 2201/5058* (2013.01)

(58) Field of Classification Search
CPC ..... A61H 2015/0021; A61H 2015/002; A61H 2015/0035; A61H 2015/0042; A61H 2015/005; A61H 2015/0057; A61H 2015/0064; A61H 2015/0071
See application file for complete search history.

(56) References Cited

U.S. PATENT DOCUMENTS

| | | | | |
|---|---|---|---|---|
| 4,813,404 | A | 3/1989 | Vallis | |
| 5,458,561 | A | 10/1995 | Schweisfurth | |
| D396,296 | S | 7/1998 | Breznik | |
| 5,997,489 | A | 12/1999 | Iwamoto et al. | |
| 7,169,120 | B2 | 1/2007 | Murdock et al. | |
| 7,988,650 | B2 * | 8/2011 | Nan ..... | A61H 15/0085 601/87 |
| 8,142,376 | B2 | 3/2012 | Gueret | |
| 2010/0049106 | A1 | 2/2010 | Gueret | |
| 2012/0041398 | A1 | 2/2012 | Wen | |
| 2012/0165708 | A1 | 6/2012 | Parsloe | |
| 2012/0209363 | A1 | 8/2012 | Williams, III et al. | |
| 2013/0048011 | A1 | 2/2013 | Bickford et al. | |
| 2014/0148744 | A1 | 5/2014 | Caldirola | |

FOREIGN PATENT DOCUMENTS

| | | |
|---|---|---|
| CN | 106109210 | 11/2016 |
| GB | 331458 | 7/1930 |
| KR | 200447358 | 1/2010 |
| KR | 200477462 | 6/2015 |
| WO | 2015139869 | 9/2015 |

OTHER PUBLICATIONS

English Translation—Machine Generared of CN106109210(A), "Rolling Massage Bar", published on Nov. 16, 2016.
English Translation—Machine Generared of CN201366065(Y), "Beauty-Care Instrument", published on Dec. 23, 2009.
English Translation—Machine Generared of KR200447358(Y1), "Finger Pressure Device of Hand", published on Jan. 20, 2010.
English Translation—Machine Generated of KR200477462(Y1), "Manual Massager", published on Jun. 10, 2015.

* cited by examiner

MASSAGE TOOL

CROSS-REFERENCE TO RELATED APPLICATIONS

The present application is a 35 USC 371 national stage entry of PCT/CA2018/050215 filed on Feb. 26, 2018 and which claims priority to U.S. provisional application No. 62/462,967 filed on Feb. 24, 2017. These documents are hereby incorporated by reference in their entirety.

FIELD OF THE DISCLOSURE

The present disclosure relates to apparatuses and kits that relate to massaging devices.

BACKGROUND OF THE DISCLOSURE

During intense physical activity, it is normal for a sport practitioner to suffer muscular aches and pains, arising from these physical activities. There are several solutions available to this person. Here are the main traditional solutions on the market:

The foam cylinder/roller: it is effective, but its range is limited, not very portable and must be placed on the ground.

The two-handed rollers: marketed in the shape of a stick with one handle on each of its end, the object is affordable, allows reasonable pressure and is relatively portable. However, its contact area for massage is not interchangeable, does not allow perpendicular therefore direct pressure, takes up more space, and its range of targetable muscular regions is limited during an auto-massage because it requires the use of both hands and arms at the same time The massage cane: it is versatile, effective and solid, but not very portable and also pretty heavy, very little known and distributed, and does not offer interchangeability in its mechanism when applying the massage, neither it offers a rolling action.

The ball for the feet: it is very affordable and effective for the feet. However, little effective for other parts of the body and few points of possible pressure.

Stretching: it is a free, effective, localized practice and is complementary to the self-massage. However, activity is limited in terms of precision on the muscles and does not activate as much blood circulation.

Pills: (anti-inflammatory, for instance) they are affordable and they are without physical effort. However, they do not target muscles in particular. The user must dose the medication and follow a dosage. When administered, the user should apply an increasing dosage.

SUMMARY

It would thus be highly desirable to be provided with an apparatus, tool, kit or method that would at least partially address the disadvantages of the existing technologies.

According to one aspect, there is provided a massage tool comprising:

- a massage head comprising at least one massage wheel mounted on a shaft, the at least one wheel being rotatable; and
- a handle coupled to the massage head, the handle defining a longitudinal axis that is generally perpendicular to a longitudinal axis defined by the shaft.

By using the technology of the present disclosure, the user can have the chance to get a massage tool, whose portable, ergonomic and versatile design allows to relax the muscles targeted by the invention. The tool can help to prevent muscle aches by using it before, during or immediately after a demanding physical activity. The tool can also allow an effective massage of sore muscles when someone suffers from aches. The tool can allow the user to exercise the massage either on oneself or on another person.

DRAWINGS

The following drawings represent non-limitative examples in which.

Figure 1:
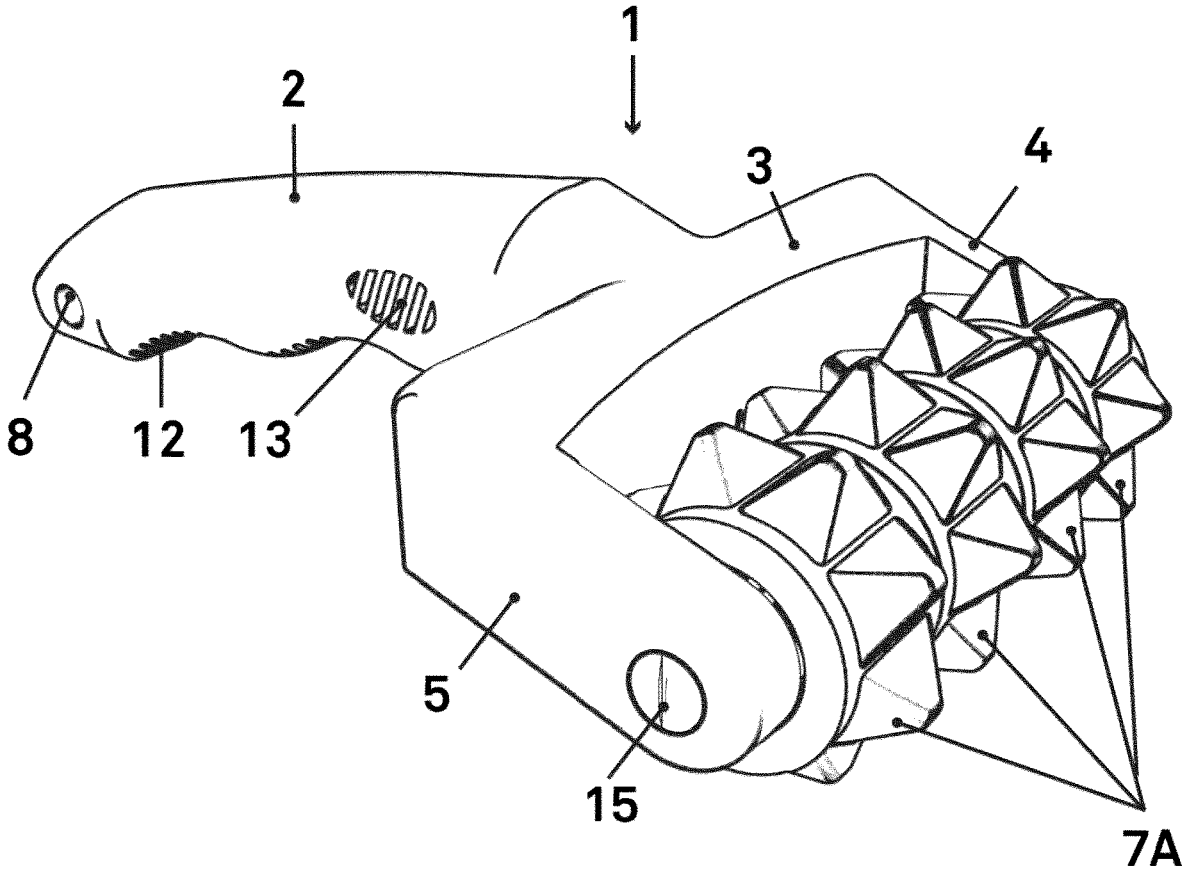
FIG. 1 is a perspective view of a massage tool according to the present disclosure.
Figure 3:
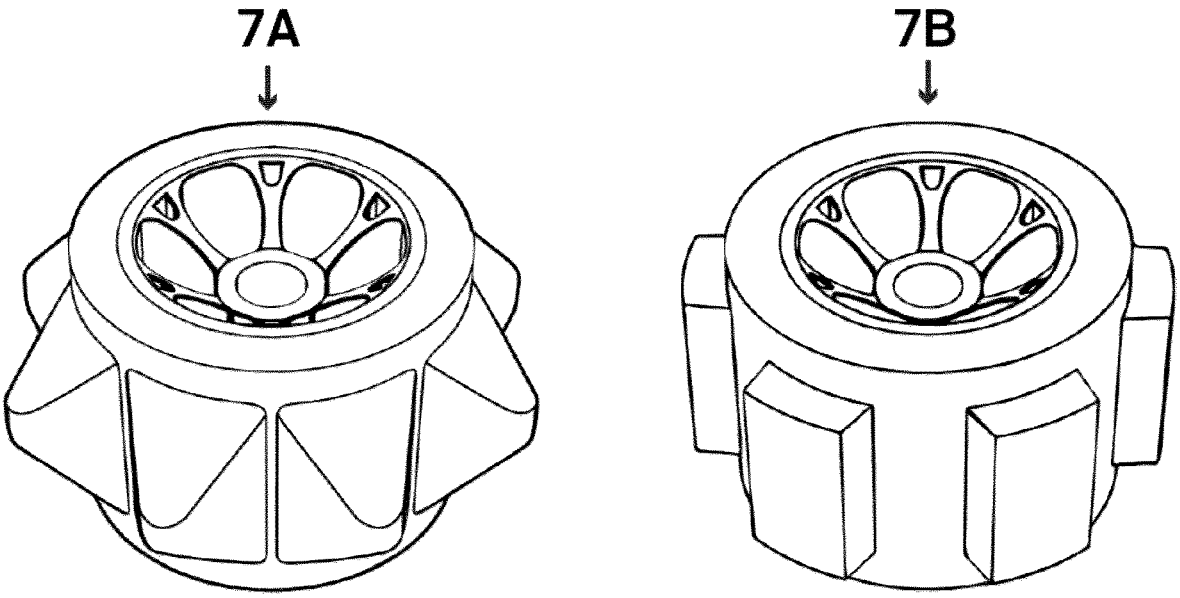
Figure 4:
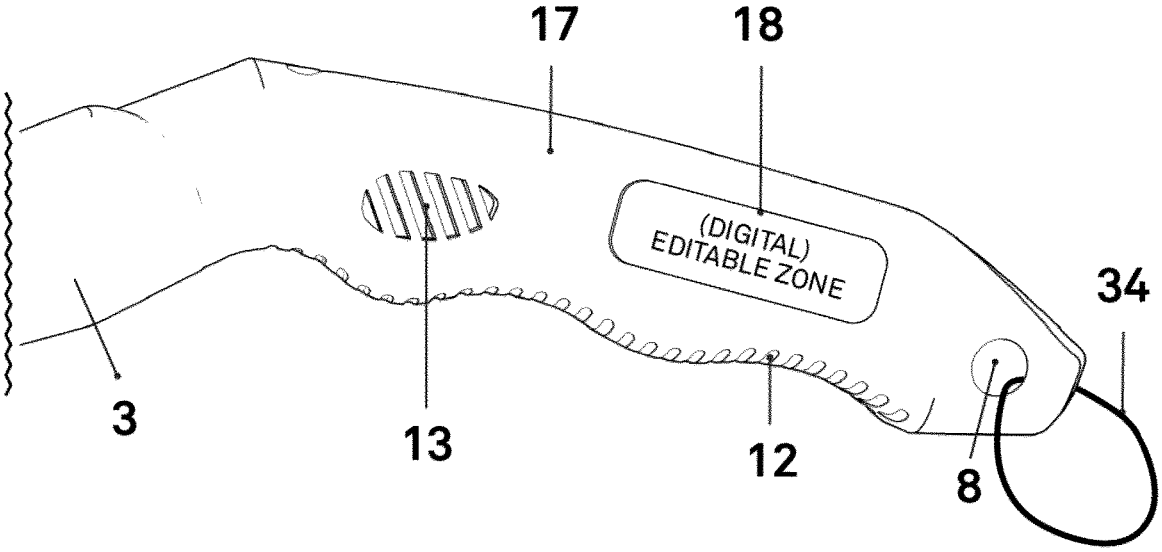
Figure 5:
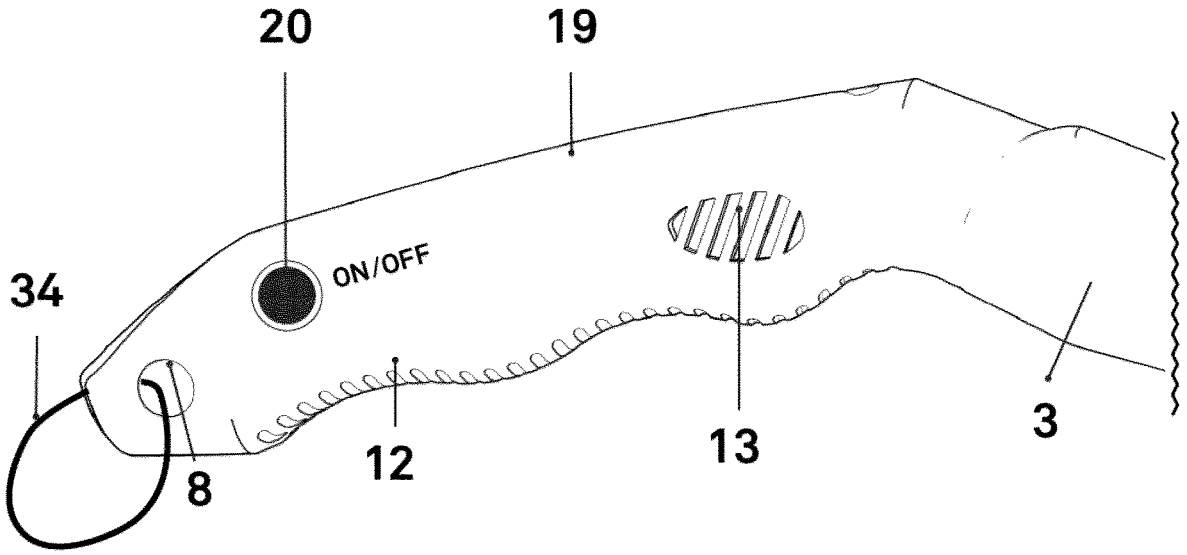
Figure 6:
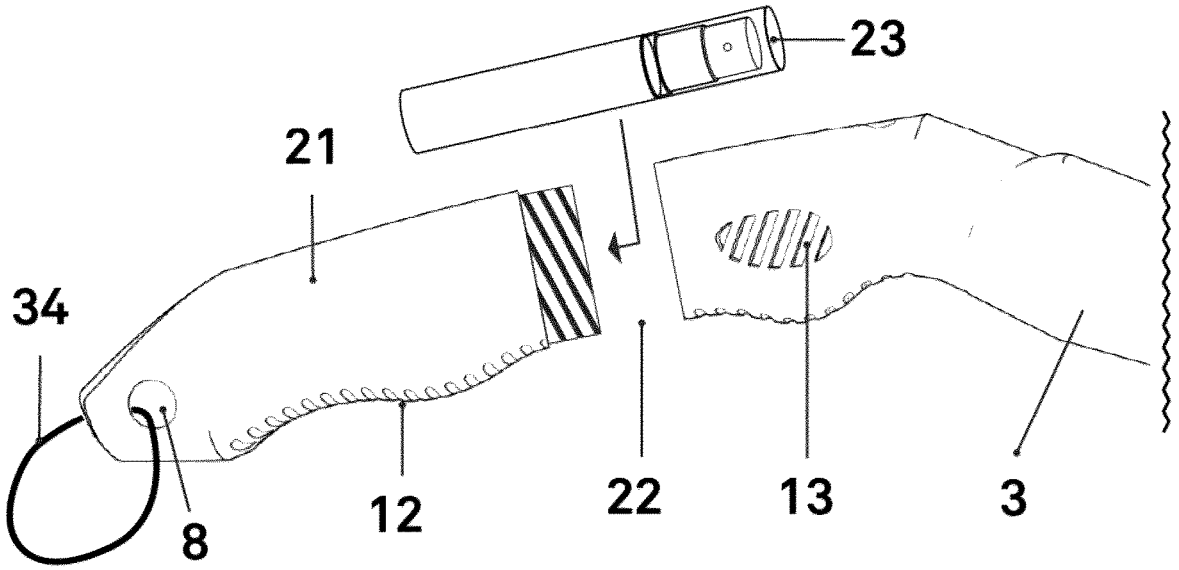
Figure 7:
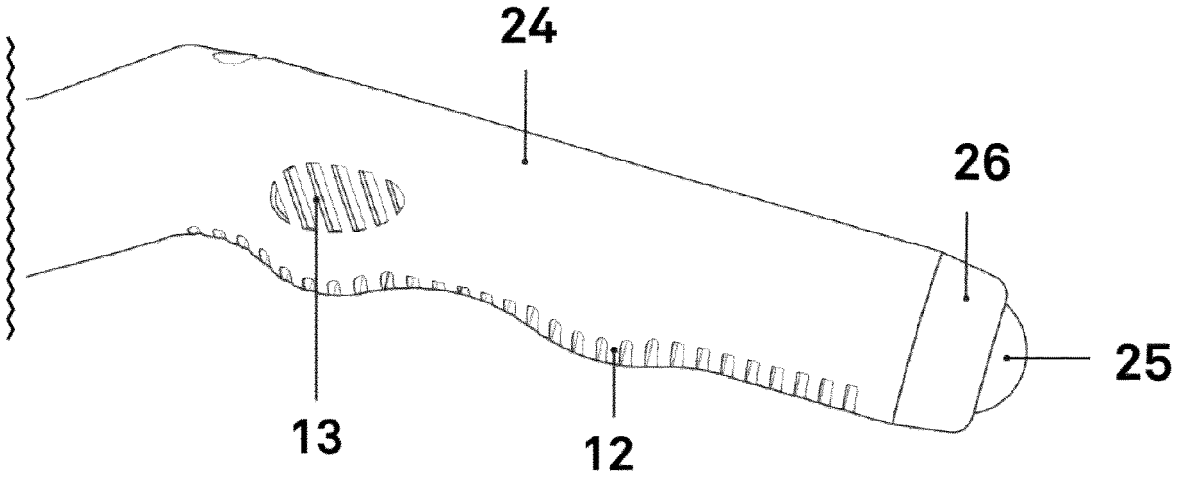
Figure 8:
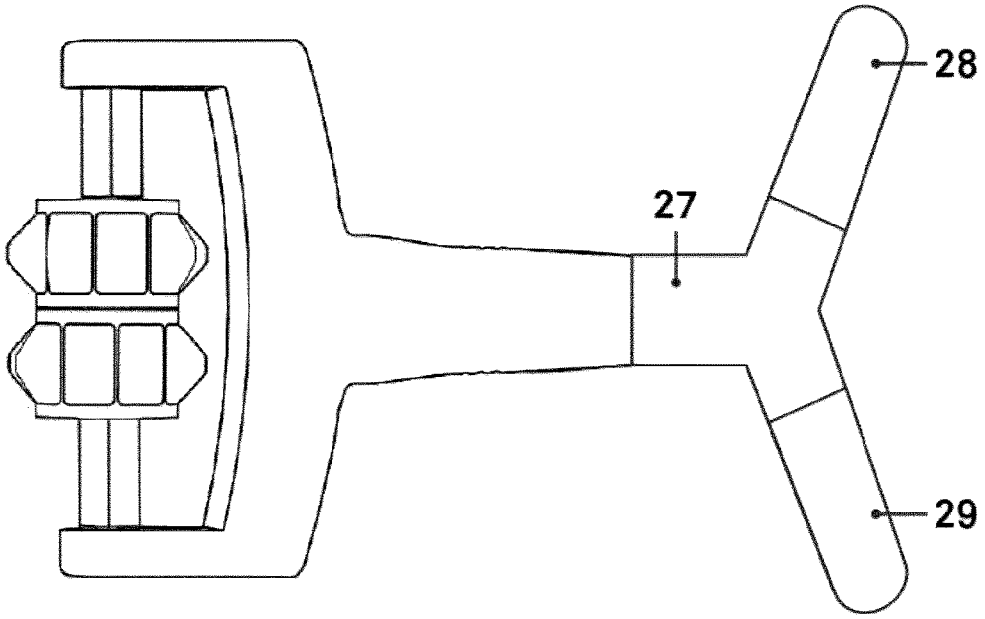
Figure 9:
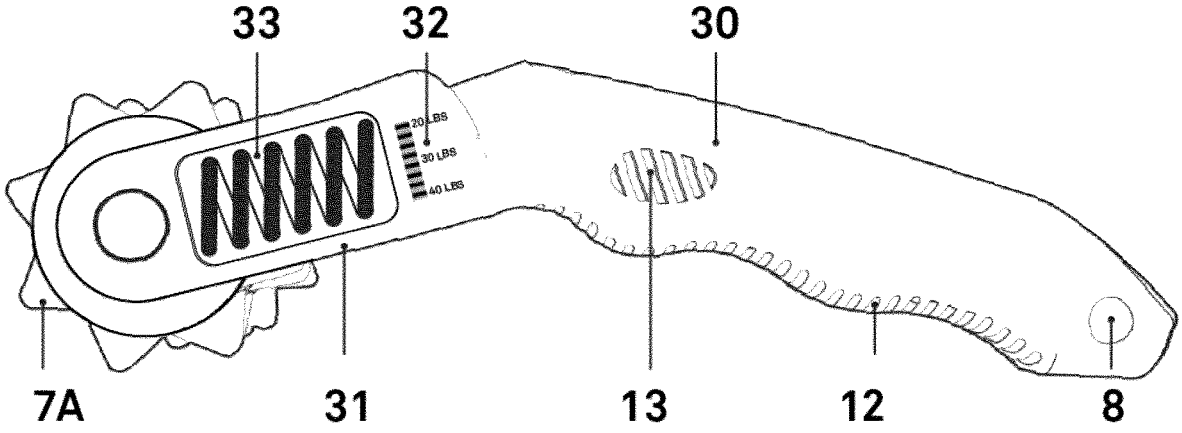
Figure 10:
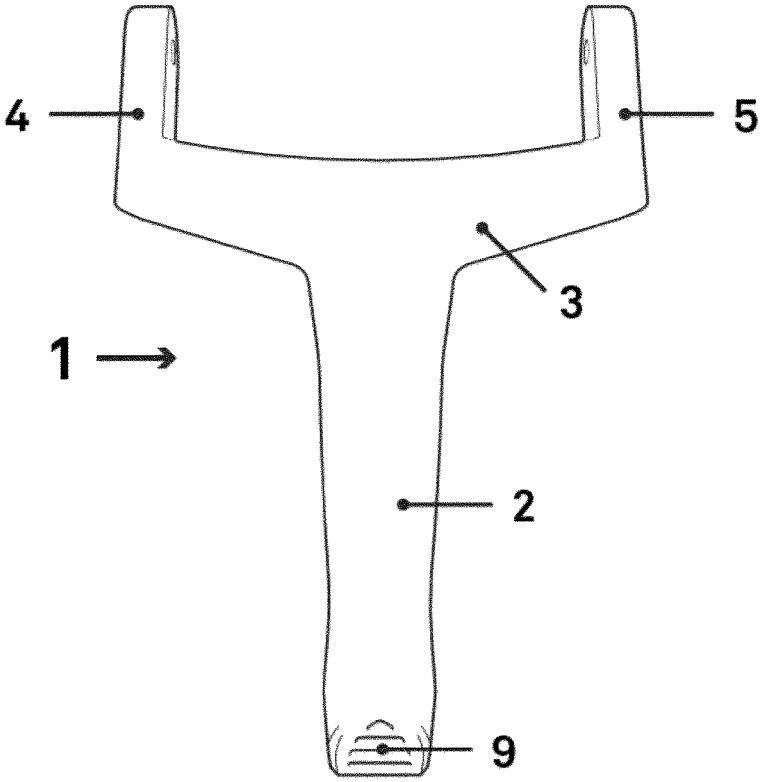
Figure 11:
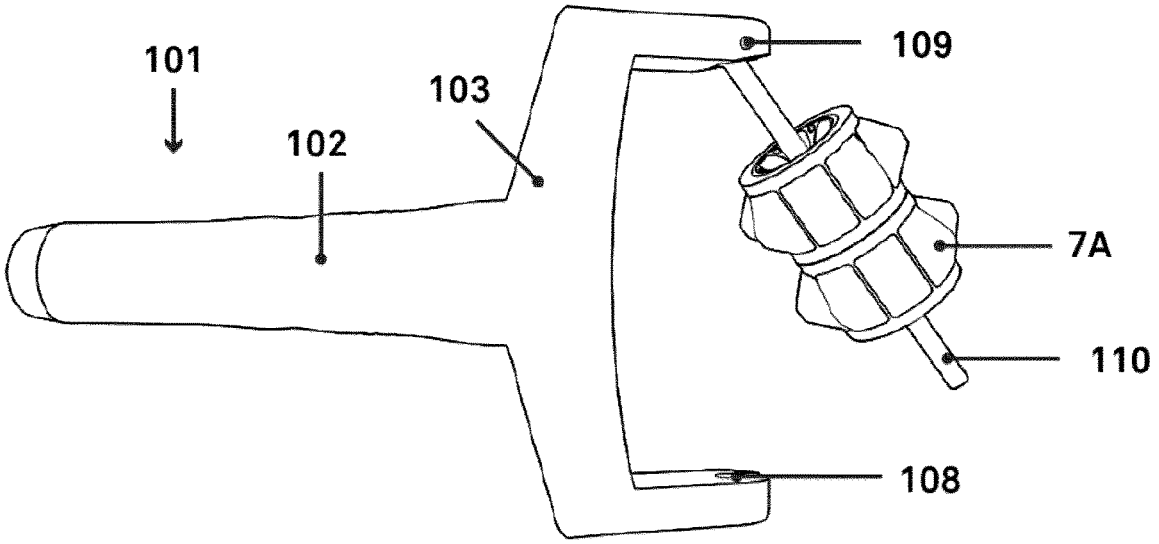
Figure 12:
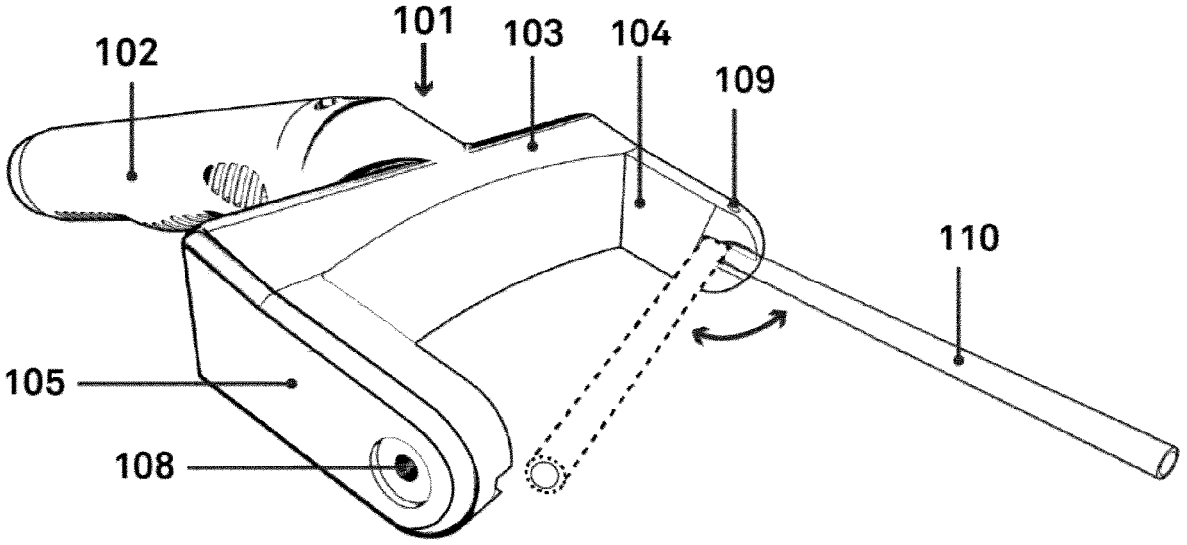
Figure 13:
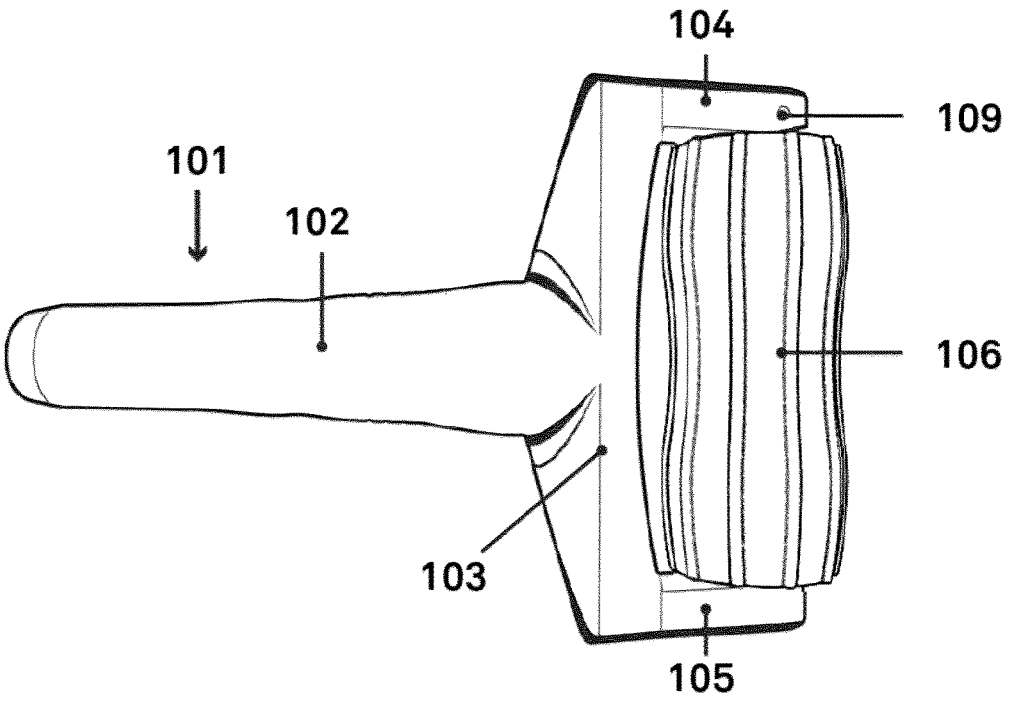
Figure 14:
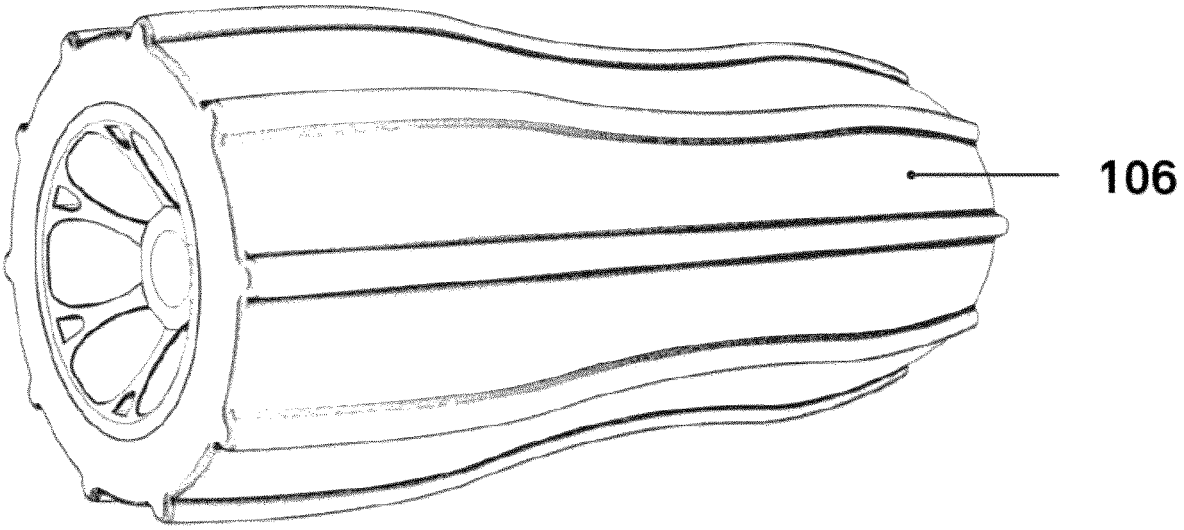

FIG. 3 a perspective view of two examples of wheel types according to another embodiment of the present disclosure;

FIG. 4 is a left side view of a handle of a massage tool comprising an editable area and an opening for passing a rope for hanging the tool when it is stored according to another embodiment of the present disclosure, wherein break lines are used to show that a head portion of the tool was voluntarily omitted for this figure;

FIG. 5 is a right side view of a handle of a massage tool comprising of an integrated vibration system according to another embodiment of the present disclosure, wherein break lines are used to show that a head portion of the tool was voluntarily omitted for this figure;

FIG. 6 is a right side view of a handle of a massage tool comprising a compartment for storing therein a cleaner bottle according to another embodiment of the present disclosure, wherein break lines are used to show that a head portion of the tool was voluntarily omitted for this figure;

FIG. 7 is a left side view of a handle of a massage tool comprising a rotating ball and rotating ball support according to another embodiment of the present disclosure, wherein break lines are used to show that a head portion of the tool was voluntarily omitted for this figure;

FIG. 8 is a top view of a massage tool handle that includes a single or two-handed handle extension characterized by a commuting member according to another embodiment of the present disclosure;

FIG. 9 is a left side view of a handle of a massage tool comprising a massage head that comprises an adjustable stiffness suspension mechanism according to another embodiment of the present disclosure;

FIG. 10 is top view of the massage tool of FIG. 1, wherein wheels and shaft have been removed, such a view of the handle shows that the massage tool is borrowing the general shape of a slingshot according to another embodiment of the present disclosure;

FIG. 11 is a top view of another example of a massage tool according to another embodiment showing a pivoting shaft mechanism herein supporting an arrangement of wheels according to another embodiment of the present disclosure;

FIG. 12 is a perspective view of the tool of FIG. 11 showing the pivoting shaft mechanism presenting the transitional mode of the interchangeability feature in the motion of its locked and released position according to another embodiment of the present disclosure, wherein solid lines are used to show the shaft in an open position and dotted lines are used to show the shaft in a semi-open position and pivoting towards a closed position;

FIG. 13 is a top view of the massage tool of FIG. 11 showing a full-length roller as a component of the massage head, the roller being configured to be in direct contact with body part to be massaged according to another embodiment of the present disclosure; and FIG. 14 is a top view of a massage tool showing an example of a full-length roller according to another embodiment of the present disclosure.

DESCRIPTION OF VARIOUS EMBODIMENTS

The following examples are presented in a non-limiting manner.

The word "a" or "an" when used in conjunction with the term "comprising" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

The terms "coupled" or "coupling" as used herein, refers for example, to the fact that that two elements or devices are directly connected to one another or connected to one another through one or more intermediate elements or devices.

According to another aspect, there is provided a kit comprising the massage tool of the present disclosure together with at least one of:

a plurality of interchange wheels;

a plurality of spacers;

a handle extension portion a two-handed handle extension;

a rotating ball and rotating ball support adapted to be connected to the tool; an electronic sensor connected to an electronic display;

and instructions for using the tool.

For example, the massage head can comprise two fingers adapted to support the shaft, the fingers defining an angle of about 10 to about 45 degrees with respect to the handle.

For example, the massage head can comprise two fingers adapted to support the shaft, the fingers defining an angle of about 20 to about 40 degrees with respect to the handle.

For example, the massage head can comprise two fingers adapted to support the shaft, the fingers defining an angle of about 25 to about 35 degrees with respect to the handle.

For example, the massage head can comprise a generally U-shaped support, wherein two parallel members define an aperture for receiving the shaft, the parallel members defining an angle of about 10 to about 45 degrees with respect to the handle.

For example, the massage head can comprise a generally U-shaped support, wherein two parallel members define an aperture for receiving the shaft, the parallel members defining an angle of about 20 to about 40 degrees with respect to the handle.

For example, the massage head can comprise a generally U-shaped support, wherein two parallel members define an aperture for receiving the shaft, the parallel members defining an angle of about 25 to about 35 degrees with respect to the handle.

For example, the at least one wheel can be rotatably mounted on the shaft.

For example, the at least one wheel can be operatively coupled to the shaft that is a rotatable shaft.

For example, the shaft can be releasably connected to the massage head.

For example, the at least one wheel can be releasably mounted on the shaft.

For example, the tool can be a one-handed tool.

For example, the handle can comprises first grippable handle region dimensioned to be held by a single hand of a user in a first position whereat a thumb of the hand of the user is at one end of the handle that is adjacent to the massage head.

For example, the user can be holding the handle in the first position with the thumb oriented generally upwardly, the massage head is extending generally upwardly.

For example, the handle can comprise a second grippable handle region dimensioned to be held by a single hand of a user in a second position whereat the thumb of the hand of the user is at one end of the handle that is opposite to the massage head.

For example, the first grippable handle region and the second grippable handle region can be disposed on opposite faces of the handle.

For example, the first grippable handle region can be disposed at a rear face of the handle and the second grippable handle region is disposed at a front face of the handle.

For example, the handle can further comprise a third grippable handle region disposed on a side face of the handle and adjacent to the massage head.

For example, the grippable handle region(s) can be textured area(s).

For example, the tool comprises a plurality of interchangeable wheels.

For example, the massage tool can further comprises at least one spacer to buffer and stabilize the wheels while performing a massage.

For example, the wheels can be made of a material that is suitable to be heated in a microwave over.

For example, the wheels can be made of a material that is microwave-safe and being adapted to keep their temperature for a predetermined period of time, enabling a user performing a massage to massage-targeted areas with hot wheels.

For example, the wheels can be made of a material suitable to be placed in a freezer.

For example, the wheels can be made of a material suitable to be placed in a freezer and being adapted keep their temperature for a predetermined period of time, enabling the person who masses to massage targeted areas with cold wheels.

For example, the plurality of wheels can comprise wheels made of different materials offering different hardnesses.

For example, the plurality of wheels can comprise wheels made of different materials offering different hardnesses, thereby enabling a user to massage targeted muscles with wheels that are more or less hard.

For example, the plurality of wheels can be made with different shapes of reliefs enabling a user to massage targeted muscles with wheels having different reliefs.

For example, the handle can comprise an editable zone enabling the personal identification of the tool (e.g.: logo of a sports club, individual name, organization associated with distribution of the tool, or other type of identification).

For example, the handle can comprise an integrated vibration system allowing for a greater activation of targeted muscles.

For example, the handle can comprise an internal compartment and a lid adapted to receive and carry with the handle further objects.

For example, the tool can have the general shape of a slingshot.

For example, the handle can comprise a socket or other commuting mechanism that allows for a handle extension to be connected to the tip of the handle.

For example, the tool can comprise a handle extension coupled with the handle commuting mechanism, providing additional gripping that is two-handed.

For example, the handle can comprise at an end opposed to the massage head, a connector for receiving receive a rotary ball adapted for massaging.

For example, the rotary ball can be adapted for massaging is brandable by adding any graphical or engraved element to it (e.g.: logo of a sports club, individual name, illustration, picture, or any other type of graphical or engraved elements).

For example, the handle can comprise an electronic sensor and an electronic display connected together, the sensor being effective to detect information related to the use of the tool and the display being effective to display such information.

For example, the massage head can comprise an adjustable stiffness suspension mechanism, thereby enabling a user to massage targeted muscles with a suspension action of the the massage head that is more or less stiff.

For example, the handle can comprise a plurality of handle size dimensioned in a way to fit variable user physiognomies (e.g. child vs adult, woman vs man, or other hand size particularities).

For example, the shaft can be pivotally connected to the massage head on one finger thereof.

For example, the shaft can be movable from a closed position whereat the shaft is frictionally engaging another finger of the massage head and securing the at least one massage wheel to the tool, to an open position whereat the shaft has one end free.

For example, the shaft can be parallel to the handle when the shaft is at the open position.

For example, the shaft can be pivotally connected to the finger of the massage head by means of a rivet or a hinge.

For example, the handle comprises two portions that are releasably connected to one another, said handle defining an internal chamber dimensioned for receiving a bottle to be disposed inside said handle.

Figure 2:
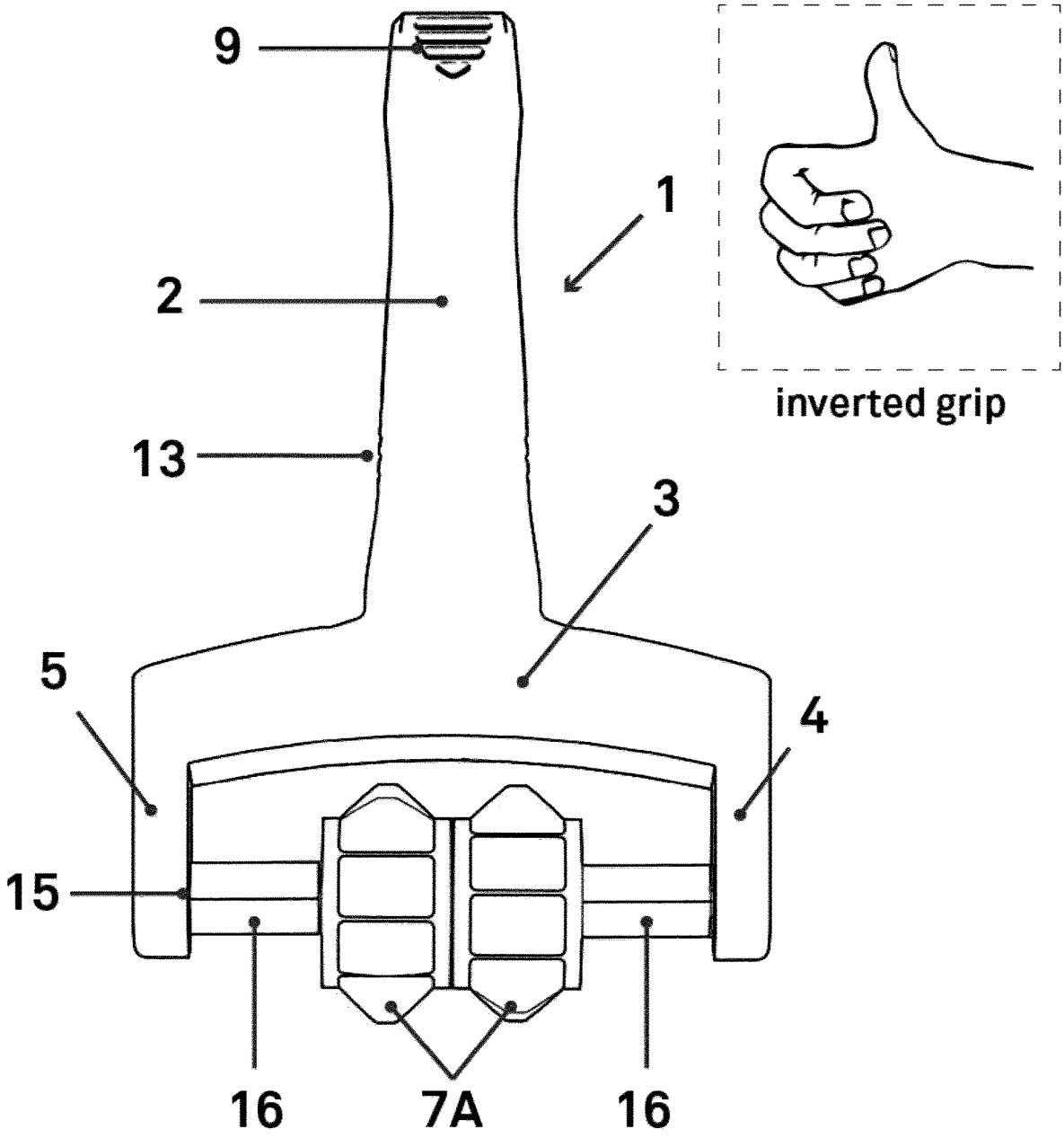
FIG. 2 is a top view of the tool of FIG. 1 with spacers and showing an inverted gripping of the tool using a textured area 9 according to one embodiment of the present disclosure.

In FIGS. 1 and 2, it will be seen that the tool (1) comprises of a handle (2) (for example rigid handle), which can be held in one hand, with a shape with an angled ergonomic profile to more easily permit an optimal perpendicular pressure on the zone to be massaged. This angulation of the handle allows the person who practices the (self-)massage not to move away his elbow from his body, which gives him a better application force. The upper extension of the handle is composed of a massage head (3) that comprises two fingers (4, 5) forming a U-shape. The two fingers (4, 5) of the massage head allow to support a shaft (15) (such a shaft can be very rigid), which supports the wheel or wheel sets (7A and 7B, for example (see FIG. 3)) and make it possible for them to rotate smoothly with a fixed centered pivot. The shaft (15) is easily disassembled and reassembled (releasable) to allow any wheel/wheel sets to be swapped according to the desire of the person exercising the massage or the self-massage.

The handle (2) includes textured areas (9, 12, 13) where the hand of the massager is positioned, thereby providing an additional ergonomic gripping during use.

The handle (2) is offered in multiple gripping sizes so users with variable hand sizes (child vs adult, woman vs man) can use the tool with a suitable fit to different and particular user physiognomies.

In FIG. 2, the textured area (9) allows the tool to be reversed with the thumb up and contacting the area (9) and the wheels (7A×2, for example) downwards, an creating a multi-gripping position tool, giving the tool more versatility to the applicability of the exerted pressure on the areas of muscles to be targeted for massage purposes.

The massage tool as shown in FIG. 2 also includes a set of spacers (16), which, like the wheels (7A, for example), is inserted through the support shaft (15). The spacers (16) serve to buffer and stabilize the wheel or wheels integrated with the tool when all the wheels in operation do not cover the entire width of the shaft (15) at the moment of use of the tool (1).

In FIG. 3, the various wheel sets (7A and 7B, for example) developed for the invention include, among others, the following characteristics: hardness, materials, textures, patterns, width, temperature control (hot or cold) and more.

The various handle variations shown in the figures and the variations in the types of wheels or rollers (7A and 7B, for example) are compatible with one another. Thus, many combinations are possible and a user can thus select a combination that fits best with his/her needs.

As seen in FIG. 4, the handle includes an opening (8) through which a knotted string (34) or the like passes to allow the tool to be suspended from a hook when not in use. The textured areas (12) and (13) are also shown. The handle (17) of the massage tool include an editable zone (18) for personalized identification of the tool (ex: sports club logo, individual name, Distribution of the tool, or other).

In FIG. 5, variations of the handle (19) of the massage tool include an electric vibration system (not shown) integrated into the handle of the tool and operating with a battery. ON/OFF button (20) for activating the vibration system is shown.

In FIG. 6, variations of the massage tool handle (21) include a compartment (22) that opens and closes easily to include a cleaning bottle (23) to be used before and/or after performing a massage with it. For example, the cleaning bottle (23) can comprise an antibacterial composition. For example, the cleaning bottle (23) can comprise ethanol or isopropanol. For example, the handle comprises two portion that are releasably connected to one another. The handle thus defines an internal chamber or compartment (22) dimensioned to receive the bottle (23). For example, when the two portions of the handle are released from one another, the user can introduce or remove the bottle (23) from inside the compartment (22). After using the bottle (23), the user can re-introduce the bottle into the compartment (22), and then reconnect together the two portions thereby hiding and storing the bottle into the handle (21).

In FIG. 7, variations of the massage tool handle (24) include a rotating ball (25) and rotating ball support (26) that allow user to massage a targeted body area.

In FIG. 8, variations of the massage tool handle (27) include a single or two-handed handle extension (28) characterized by a commuting member (29) that allow user another gripping position in order to use two hands to massage a targeted body area. Such a handle having an end (opposed to the massage head) that has a Y-shape or a V-shape can be quite useful for applying pressure by using two hands (see extension 28 and member 29).

In FIG. 9, variations of the massage tool handle (30) include a massage head (31) that comprises an adjustable stiffness suspension mechanism (33) that allow the user to control the stiffness of the massage head to massage targeted muscles with a suspension action, which is more or less stiff. The suspension mechanism (33) is connected to the massage head and can comprise a spring effective for applying a desired or selected pressure on the massage head. The adjustor (32) is connected to the stiffness suspension mechanism (33) and allows for selecting the desired pressure to be applied to the massage head.

As it can be seen in FIG. 10, the general shape of the tool (1) is inspired by the shape of a slingshot.

In FIG. 11, a variant of the massage tool (1) shown in FIG. 1 is provided. In fact, the massage tool (101) includes a handle (102), a massage head (103) that comprises a pivoting shaft mechanism characterized by a pivoting shaft (110) supporting herein an arrangement of wheels (7A). The pivoting shaft (110) is shown in a semi-open, a position at which wheels can be removed therefrom or inserted thereon. The shaft (110) is pivotally connected to the massage head (103) (more precisely to finger (104) for example by means of a rivet (109) connected to a first end of the shaft. The shaft (110) can then be pivoted to a closed position and the shaft (110) will be frictionally engaging the finger (105) with a second end thereof. A hinge can also be used instead of a rivet. For example, a lock-and-release mechanism (108) can be used for maintaining the shaft (110) connected to the finger (105) by frictional engagement. In FIG. 12, the massage tool (101) of FIG. 11 is shown in a perspective view. The various elements are shown: handle (102), the massage head (103) that comprises the pivoting shaft mechanism comprising a pivoting shaft (103) connected to finger (104) by means of a rivet (109). The shaft (110) in solid line is shown in a fully opened position whereat the shaft (110) is parallel to the handle (102). The shaft (110) in dotted lines is shown in a semi-open position and pivoting towards a closed position whereat the shaft (110) will fictionally engage the lock-and-release mechanism (108).

In FIG. 13, the massage tool (101) is shown with a full-length roller (106). For example, such a roller can bein direct contact with a body part to be massaged.

In FIG. 14, there is shown a full-length roller (106). Such a roller can include, among others, the following characteristics: hardness, materials, textures, patterns, width, temperature control (hot or cold).

The embodiments of the paragraphs of the present disclosure are presented in such a manner in the present disclosure so as to demonstrate that every combination of embodiments, when applicable can be made. These embodiments have thus been presented in the description in a manner equivalent to making dependent claims for all the embodiments that depend upon any of the preceding claims (covering the previously presented embodiments), thereby demonstrating that they can be combined together in all possible manners. For example, all the possible combination, when applicable, between the embodiments of any paragraphs and the device of the SUMMARY are hereby covered by the present disclosure.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

The invention claimed is:

1. A massage tool comprising:

a massage head comprising at least one massage wheel mounted on a shaft, said at least one wheel being rotatable; and a handle coupled to said massage head, said handle defining a longitudinal axis that is generally perpendicular to a longitudinal axis defined by said shaft, wherein said shaft is hingedly connected to said massage head on a first finger thereof, said shaft being pivotable from a closed position whereat said shaft is frictionally engaging a second finger of said massage head and securing said at least one massage wheel to said tool, to an open position whereat said shaft has one end free, and wherein said shaft is parallel to said handle when said shaft is at said open position.

2. The massage tool of claim 1, wherein said massage head comprises the first and second fingers adapted to support said shaft, and wherein an angle of about 10 to about 45 degrees is defined between a longitudinal axis defined by each of said fingers and the longitudinal axis defined by said handle.

3. The massage tool of claim 1, wherein said massage head comprises the first and second fingers adapted to support said shaft, and wherein an angle of about 20 to about 40 degrees is defined between a longitudinal axis defined by each of said fingers and the longitudinal axis defined by said handle.

4. The massage tool of claim 1, wherein said massage head comprise a generally U-shaped support, wherein the first and second fingers are parallel and define an aperture for receiving said shaft, and wherein an angle of about 10 to about 45 degrees is defined between a longitudinal axis defined by each of said fingers and the longitudinal axis defined by said handle.

5. The massage tool of claim 1, wherein said massage head comprise a generally U-shaped support, wherein the first and second fingers are parallel and define an aperture for receiving said shaft, and wherein an angle of about 20 to about 40 degrees is defined between a longitudinal axis defined by each of said fingers and the longitudinal axis defined by said handle.

6. The massage tool of claim 1, wherein the at least one wheel is rotatably mounted on said shaft.

7. The massage tool of claim 1, wherein the at least one wheel is operatively coupled to said shaft that is a rotatable shaft.

8. The massage tool of claim 1, wherein said shaft is releasably connected to said massage head.

9. The massage tool of claim 1, wherein said at least one wheel is releasably mounted on said shaft.

10. The massage tool of claim 1, wherein said tool is a one-handed tool.

11. The massage tool of claim 1, wherein said handle comprises a first grippable handle region dimensioned to be held by a single hand of a user in a first position whereat a thumb of the hand of the user is at one end of the handle that is adjacent to said massage head.

12. The massage tool of claim 1, wherein said tool comprises a plurality of interchangeable wheels.

13. The massage tool of claim 12, further comprising at least one spacer to buffer and stabilize said wheels while performing a massage.

14. The massage tool of claim 12, wherein the plurality of wheels are made with different shapes of reliefs enabling a user to massage targeted muscles with wheels having different reliefs.

15. The massage tool of claim 1, wherein the handle comprises an integrated vibration system allowing for a greater activation of targeted muscles.

16. The massage tool of claim 1, wherein the tool has the general shape of a slingshot.

17. The massage tool of claim 1, wherein the handle comprises a socket or other commuting mechanism that allows for a handle extension to be connected to a tip of the handle.

* * * * *